US005816119A

United States Patent [19]

Herué

[11] Patent Number: 5,816,119

[45] Date of Patent: Oct. 6, 1998

[54] TIGHTENING TOOL, ESPECIALLY SCREWDRIVER

[75] Inventor: Gomas Herué, Saint Farjeau Ponthierry, France

[73] Assignee: Facom, Morangis Cedex, France

[21] Appl. No.: 553,491

[22] PCT Filed: Apr. 20, 1995

[86] PCT No.: PCT/FR95/00521

§ 371 Date: Nov. 20, 1995

§ 102(e) Date: Nov. 20, 1995

[87] PCT Pub. No.: WO95/29041

PCT Pub. Date: Nov. 2, 1995

[30] Foreign Application Priority Data

Apr. 20, 1994 [FR] France ..... 94/04741

[51] Int. Cl.[6] ..... B25B 13/46; B25B 23/16

[52] U.S. Cl. ..... 81/60; 81/177.8; 81/440

[58] Field of Search ..... 81/60–63.2, 177.7–177.9, 81/440, 177.1, 177.2, 177.85

[56] References Cited

U.S. PATENT DOCUMENTS

| | | | |
|---|---|---|---|
| 2,512,232 | 6/1950 | Hart | 81/63 X |
| 2,572,444 | 10/1951 | Carden | 81/177.8 |
| 3,068,728 | 12/1962 | Shepherd . | |
| 4,597,478 | 7/1986 | Bodnar | 81/62 X |
| 5,069,091 | 12/1991 | Bramsiepe et al. | 81/177.9 X |
| 5,101,696 | 4/1992 | Neff . | |
| 5,450,775 | 9/1995 | Kozak | 81/440 |

FOREIGN PATENT DOCUMENTS

| | | | |
|---|---|---|---|
| 2570975 | 4/1986 | France . | |
| 2578772 | 9/1986 | France . | |
| 415280 | 10/1946 | Italy | 81/60 |

*Primary Examiner*—D.S. Meislin
*Attorney, Agent, or Firm*—Wenderoth, Lind 7 Ponack

[57] ABSTRACT

A tightening tool which includes a driving part forming a grip of a handle of the tool and a driven part which includes a blade holder and is a complementary distal part of the handle. These two parts have, in a first position of use, a common axis of rotation, a device for allowing tilting the driving part with respect to the driven part. The tilting device includes at least one transverse spindle which is integral with one of the two parts and is able to move in a longitudinal slot of the other part. The slot is equipped with a stop. Also, a locking arrangement can adopt a position for positive locking of the driving part in a position which is coaxial with the driven part. The locking arrangement forms a plug and socket type connection between the two parts. The parts additionally have a position for allowing the tilting of the driving part. The tilting position is obtained by relative coaxial displacement of the two parts to a predetermined position of separation.

11 Claims, 3 Drawing Sheets

TIGHTENING TOOL, ESPECIALLY SCREWDRIVER

BACKGROUND OF THE INVENTION

The present invention relates to a tightening tool of the type including a driving part and a driven part which, in a first position of use, have a common axis of rotation, means for tilting the driving part with respect to the driven part, and locking means which can adopt a position for positive locking of the driving part in a position coaxial with the driven part as well as a position for freeing the tilting means. It applies in particular to screwdrivers.

In a known screwdriver of this type (FR-A-2,570,975), the driving part forms the entire handle, and the driven part consists of the blade of the screwdriver. To allow tilting, the handle has a longitudinal slit, which severely detracts from the comfort with which the handle is grasped in the first position of use.

SUMMARY OF THE INVENTION

The object of the present invention is to provide economic and reliable means which make it possible to exert either a relatively low torque or a much higher torque on a component, making use of a tool which is identical to the conventional tools in the first position of use. In particular, in the case of a screwdriver, this involves making it possible to screw-in quickly, followed by vigorous tightening at the end of the screwing-in operation, or alternatively, loosening of a screw, followed by quick unscrewing.

To this end, the subject of the present invention is a tightening tool of the aforementioned type, characterized in that:

- the driving part comprises a proximal part, forming a grip, of the handle of the tool;
- the driven part comprises a tool-blade holder and the complementary distal part of the handle of this tool;
- the two parts are mounted so that they can move coaxially with respect to each other as far as a predetermined position of separation in order to free the tilting means;
- the tilting means comprise at least one transverse spindle integral with one of the two parts and able to move in a longitudinal slot of the other part equipped with a stop; and
- the locking means comprise a plug and socket type connection between the driving part and the driven part.

The tightening tool according to the invention may include one or more of the following characteristics:

- in the locked position of the locking means, the driving part and driven part are in mutual contact via their respective end faces;
- the longitudinal slot is borne by the male part of the plug and socket type connection and the transverse pin is integral with the female part of the plug and socket type connection;
- the transverse spindle is adjacent the end of the part which bears it;
- the plug and socket type connection comprises mutual guidance of the two parts by means of a non-circular shape;
- in the said predetermined separation position, the two parts interact via planar surfaces which are parallel to a predetermined plane of tilting;
- the tool comprises braking means, particularly a snap ring, designed to increase the friction between the two parts, driving and driven, during their coaxial displacements;

- the said proximal part of the handle forms a grip having an external shape of revolution.
- the blade holder includes an auxiliary torque-transmitting device, especially a ratchet mechanism; and
- the blade passes through the said auxiliary device and butts up against the blade holder above this device.

BRIEF DESCRIPTION OF THE DRAWINGS

One embodiment of the invention will now be described in relation to the appended drawings, in which.

DETAILED DESCRIPTION OF THE INVENTION

Figure 1:
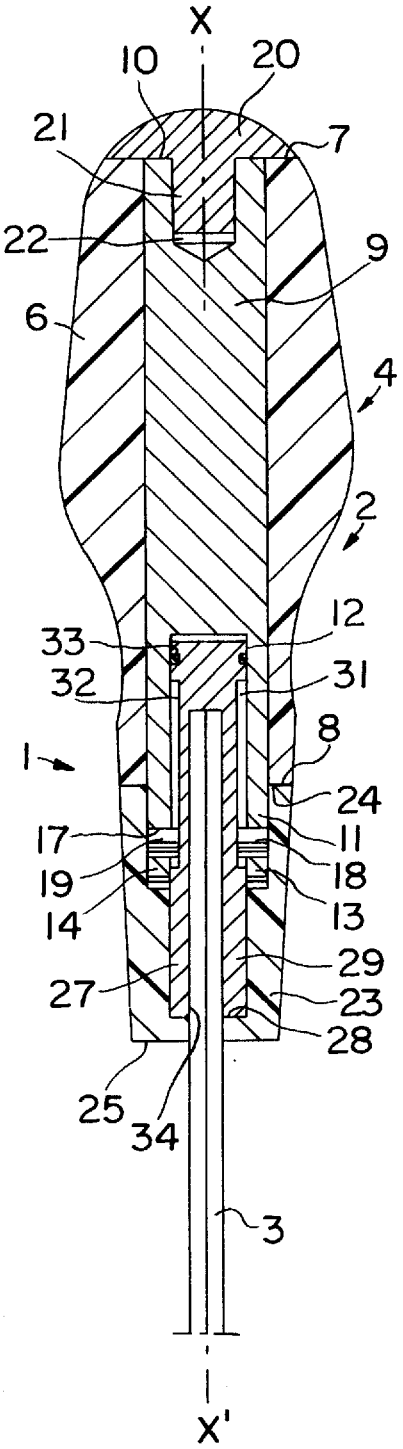
- FIG. 1 is a longitudinal section of a screwdriver according to the present invention, in a locked position of a tilting mechanism.

Referring to FIGS. 1 to 6, the tightening tool is described as applied to a screwdriver 1. This screwdriver 1 includes a handle 2 bearing a blade 3 and, in a normal position of use, has an overall axis X–X' which is assumed to be vertical.

The handle 2 of the screwdriver 1 can be broken down into a driving part or grip 4, and a driven part or blade holder 5.

The grip 4 includes an outer jacket 6 symmetrical about the axis X–X', of a form suitable to be easy for an operator to grasp. The jacket 6, for example made of plastic, has an elongate shape and has two end faces, an upper one 7 and a lower one 8 which are planar and horizontal.

The jacket 6 surrounds a cylindrical core 9 which is, for example, made of steel. An upper end 10 of the core 9 lies flush with the end 7 of the jacket 6, and a lower part 11 projects below the end 8 of the jacket.

Figure 4:
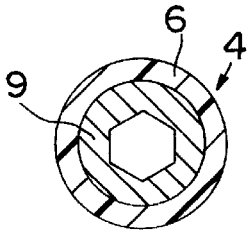
- FIGS. 4 and 5 are transverse sectional views taken on lines IV—IV and V—V of FIG. 3, respectively.

Over a portion less than of the order of one third of its length, the core 9 has a blind axial hexagon bore 12 as shown in FIG. 4. The bore 12 markedly penetrates the jacket 6 and is downwardly open.

Figure 5:
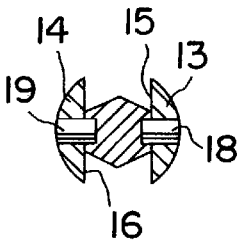

FIG. 5 shows that the projecting lower part 11 of the core 9 has diametrically opposed slits is slit along the length of the bore 12, so as to form two legs 13 and 14 which are diametrically opposed and symmetric with respect to the axis X–X'. These legs are internally delimited by respective planar and parallel surfaces 15, 16 forming part of the aforementioned hexagon.

A through-bore 17 is formed through legs 13, 14, close to their free end, this bore being horizontal and perpendicular to the surfaces 15 and 16 and of a small diameter by comparison with that of the bore 12. Fixed inside bore 17 are two studs 18 and 19, lying flush with the external surface of the legs 13 and 14 respectively, and projecting slightly inwardly with respect to the surfaces 15 and 16.

The upper end 7 of the jacket 6 bears a plug 20 in the form of a part spherical cap, having a base diameter equal to that of the end 7. The plug 20 is fixed by a cylindrical finger 21 inserted in a blind bore 22 of axis X–X' formed in the core 9, the bore 22 being of a depth slightly greater than the length of the finger 21.

The blade holder 5 includes a body 23, for example made of plastic, externally frustoconical and tapering slightly towards the bottom, having two planar and horizontal end faces, an upper one 24, and a lower one 25. Along the axis X–X', there is a bore passing through body 23, the bore having two successive reductions in diameter. The portion of bore 26 having the largest diameter extends over approximately half the height of the body 23 starting from the upper end 24 thereof, so as to be slightly deeper than the length of the projecting lower part 11 of the core 9. The diameter of the portion 26 is equal to the outside diameter of the core.

The intermediate portion of bore 27 has a hexagonal cross-section identical to that of the bore 12, and the second reduction in diameter defines a horizontal shoulder 28 close to the lower end 25 of the body 23.

A shaft 29 of axis X–X', for example made of steel, having a hexagon cross-section to mate with the portion 27 of the bore 12, is forcibly inserted into the body 23 from the top until it butts up on the shoulder 28. An upper portion 30 of the shaft 23 projects above the upper end 24 of the body 23.

Two longitudinal and diametrically opposed slots 31 and 32 extend upwards along the shaft 29, substantially starting from the end of the portion of bore 26. The depth of the slots allows the projecting ends of the studs 18 and 19 to be inserted into the slots 31 and 32, with the surfaces 15 and 16 of the legs 13 and 14 in contact with two opposed flaps of the shaft 29.

A radially elastic circular elastic snap ring 33 is accommodated in a peripheral groove of the shaft 29 at the end of the upper portion 30 of the shaft 29, above the slots 31 and 32, so as to increase the friction between the shaft 29 and the adjacent surfaces of the bore 12 and of the legs 13, 14.

A blind bore 34 extends along most of the length of the shaft 29. The bore opens at the lower end of the shaft and has a diameter slightly less than that of the lower portion of the body 23. The screwdriver blade 3 is inserted into bore 34 from below with friction and abuts against the bottom of the bore.

Figure 6:
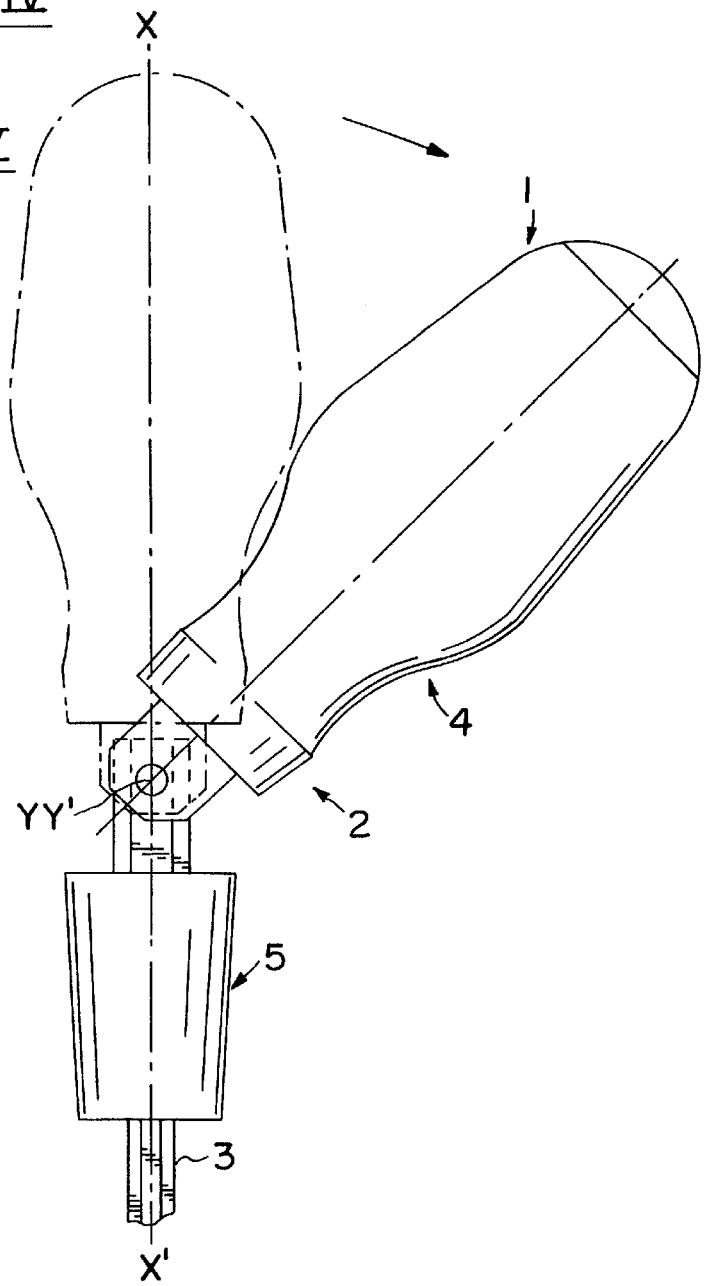
- FIG. 6 represents the screwdriver in the unlocked position of the tilting mechanism, with the handle in the process of being tilted, the view being taken in the direction of the arrow VI of FIG. 2.

The operation of the screwdriver 1 is now explained with reference to FIGS. 1, 2 and 6. In order to commence the screwing operation, the screwdriver is used as an ordinary screwdriver, in the configuration of FIG. 1. The grip 4 is vertically aligned with the blade holder 5, and is locked into the latter, against any tilting. More specifically, the lower part 11 of the grip 4 is fitted into the portion of bore 26 of the blade holder 5, while the upper part 30 of the shaft 29 is inserted into the bore 12. The locking may be qualified as "positive" because it remains so when the user exerts a screwing/unscrewing torque and/or a downwards thrust and/or a leverage force in any radial plane, that is to say for any usual action exerted when using a conventional screwdriver.

In this situation, the rings defined by the surfaces 8 and 24 are in mutual contact, and the external surfaces of the parts 4 and 5 connect together exactly so that the assembly 6, 20, 23 has the appearance of a conventional screwdriver handle, without a projecting element.

To carry out most of the screwing operation, the grip 4 rotationally drives the blade holder 5 by virtue of the hexagon shape of the bore 12 and of the shaft 29 and possibly by virtue of the interaction of the studs 18 and 19 and of the slots 31 and 32.

It will be appreciated that in this position, if the top of the handle is struck, the impact is transmitted directly to the blade holder 5 via the contacting surfaces 8 and 24, without the risk of damaging the internal tilting mechanism.

After the operator has more or less completed a screwing operation, he wishes to exert a high torque on the screw. For that, the grip 4 is therefore unlocked, holding the blade holder 5 stationary and pulling the grip 4 inwardly. The studs 18 and 19 slide in the slots 31 and 32 until they come into abutment at the upper end thereof. As the upper part of the shaft 29 is now entirely between the legs 13 and 14, the grip 4 may be tilted about a horizontal axis Y–Y' defined by the studs 18 and 19, as FIG. 6 shows. The driving part 4 thus constitutes a lever arm, and it is easy to exert a high torque on the screw, transmitted to the blade holder 5 via the surfaces 15 and 16.

It should be noted that as the legs 13 and 14 do not extent much beyond the studs 18 and 19, they do not project relative to the blade holder 5 and therefore do not increase the overall bulk of the tool when the grip 4 is tilted. Furthermore, there is no risk of the grip tilting unintentionally during use in the "normal" position.

Figure 7:
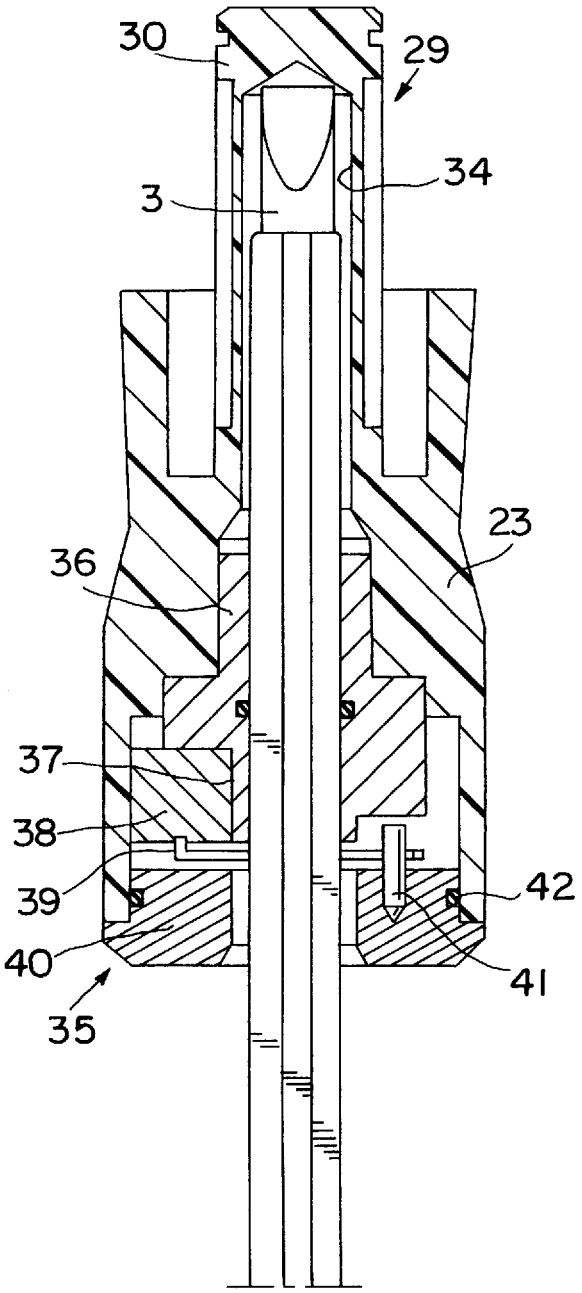
- FIG. 7 represents part of an alternative embodiment in longitudinal section on a larger scale.

FIG. 7 represents an alternative blade holder 5 in which a reversible ratchet mechanism 35 is incorporated. The ratchet mechanism has a conventional overall structure, with a stationary part including the body 23, a rotor 36 which has a planar vertical surface 37 extending along a chord, a moving wedge 38, a spring 39 for urging this wedge towards one or other end of the surface 37, and a selector ring 40 which internally bears a stud 41 for acting on the spring. The ring 40 is mounted so that it can rotate at the lower end of the body 23 by means of a circular elastic snap ring 42, and rotating it in one direction or the other defines the active direction of the ratchet mechanism.

Figure 2:
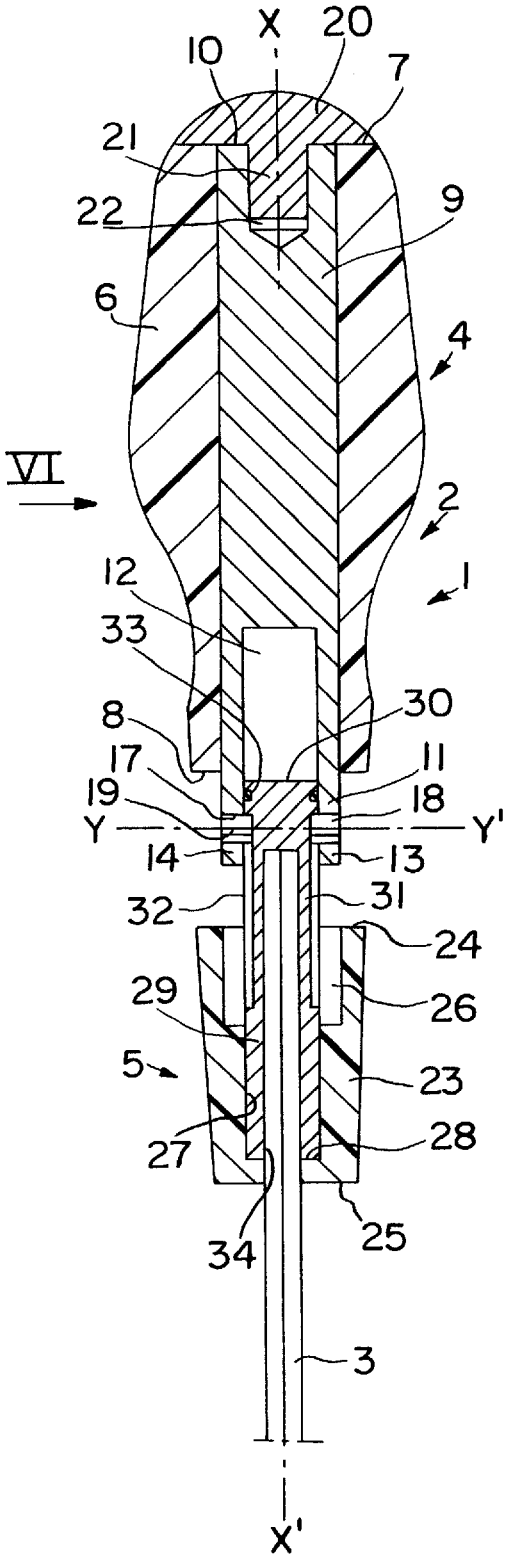
- FIG. 2 is a similar view of the screwdriver of FIG. 1, in an unlocked position of the tilting mechanism.
Figure 3:
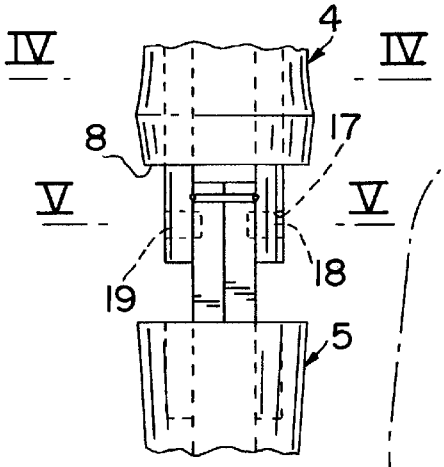
- FIG. 3 is a part elevation view of the tilting mechanism.

In this alternative, the shaft 29 of FIGS. 1 and 2 is formed integrally with the body 23. The blade 3 (which, in the example represented, is reversible) passes freely through a central orifice in the ring 40, then passes with friction through the rotor 36 and the shaft 29 until it butts up against the bottom of the bore 35 of the shaft.

By virtue of this layout, when the screwdriver is fitted together and in its normal position similar to that of FIG. 1, a vertical impact exerted on the handle of the screwdriver is transmitted directly to the blade 3, without in any way affecting the ratchet mechanism 35.

I claim:

1. A tool comprising:

a first handle portion having an end face;

a second handle portion connected to said first handle portion such that said first handle portion is axially moveable relative to said second handle portion between a first position in which said first handle portion is axially aligned with a central longitudinal axis of said second handle portion, and a second position, said second handle portion being capable of holding a tool blade in alignment with said central longitudinal axis of said second handle portion;

at least one transverse spindle connected to one of said first handle portion and said second handle portion, said at least one spindle being transverse relative to said central longitudinal axis of said second handle portion; and a slot formed in the other of said first handle portion and said second handle portion, said slot slidably receiving said at least one spindle and having stop surfaces to limit axial movement of said first handle portion between said first position and said second position, wherein said first handle portion can pivot about said at least one spindle in said second position, said first handle portion and said second handle portion engage in said first position to form a socket and plug type connection which prevents pivotal movement of said first handle portion in said first position, and said socket and plug connection comprises a first male element of said first handle portion which is received in a first mating recess formed in said second handle portion, and a second male element of said second handle portion which is received in a second mating recess of said first handle portion.

2. The tool as claimed in claim 1, wherein, in said second position, said first handle portion and said second handle portion have corresponding planar surfaces which are parallel and determine a plane of tilting of said first handle portion about said at least one transverse spindle.

3. A tool handle comprising:

a first handle portion having an exterior surface and a longitudinally extending portion defining an open-ended interior space;

a second handle portion, connected to said first handle portion such that said first handle portion is axially moveable relative to said second handle portion between a first position in which said first handle portion is axially aligned with a central longitudinal axis of said second handle portion and a second position, said second handle portion being capable of holding a tool blade and having a central axis, an open-ended through hole for receiving said longitudinally extending portion of said first handle portion in said first position of said first handle portion, and a central axially extending projection mounted in said through hole and slidably received in said interior space of said first handle portion;

at least one spindle connected to one of said longitudinally extending portion of said first handle portion and said central axially extending projection of said second handle portion, said at least one spindle being positioned orthogonally relative to said central axis of said second handle portion;

a slot provided in the other of said longitudinally extending portion of said first handle portion and said central axially extending projection of said second handle portion, said slot slidably receiving said at least one spindle and including stop surfaces which limit axial movement of said first handle portion between said first position at which said first handle portion is locked in axial alignment with said central axis of said first handle portion and said second position at which said first handle portion is pivotable about said at least one spindle.

4. The tool handle as claimed in claim 3, wherein said first handle portion has a end face and said second handle portion has an end face which engages said end face of said first handle portion in said first position.

5. The tool handle as claimed in claim 3, wherein said at least one spindle is mounted in an end of said longitudinally extending portion of said first handle portion, and said slot is formed in an exterior surface of said central axially extending portion.

6. The tool handle as claimed in claim 3, wherein said first handle portion has an exterior surface which is configured to form a gripping surface.

7. The tool handle as claimed in claim 3, wherein said longitudinally extending portion of said first handle portion has diametrically opposed slits in an end portion thereof to permit pivoting movement of said first handle portion in said second position.

8. The tool handle as claimed in claim 7, wherein said slits define two diametrically opposed part cylindrical portions having planar interior surfaces which slidably engage planar parallel exterior surfaces of said central axially extending projection of said second handle portion to guide pivotal movement of said first handle portion.

9. The tool handle as claimed in claim 3, wherein said longitudinally extending portion of said first handle portion has an interior peripheral surface which is non-cylindrical and said central axially extending projection of said second handle portion has an outer peripheral surface which is non-cylindrical and mates with said interior peripheral surface of said longitudinally extending portion of said first handle portion to prevent relative rotation between said first handle portion and said second handle portion.

10. The tool handle as claimed in claim 3, wherein said first handle portion is a major part of the tool handle and said second handle portion is a minor part of the tool handle.

11. The tool handle as claimed in claim 3, wherein said first handle portion and said second handle portion together from a screwdriver handle in said first position of said first handle portion.

* * * * *